United States Patent [19]

McInnis

[11] 4,227,453

[45] Oct. 14, 1980

[54] IMPRINTING OF TIME CLOCK DATA

[75] Inventor: Andrew M. McInnis, Covina, Calif.

[73] Assignee: DBS, Inc., Randolph, Mass.

[21] Appl. No.: 916,599

[22] Filed: Jun. 19, 1978

[51] Int. Cl.[2] ..... B41F 3/02

[52] U.S. Cl. ..... 101/45; 101/269; 346/80

[58] Field of Search ..... 101/45, 56, 269, 110, 101/42, 379, 380; 400/55-59; 346/80-82

[56] References Cited

U.S. PATENT DOCUMENTS

| | | | |
|---|---|---|---|
| 2,757,063 | 7/1956 | Pagnard | 346/80 X |
| 3,405,634 | 10/1968 | Maul et al. | 101/45 |
| 3,521,556 | 7/1970 | Barbour | 101/45 X |
| 3,626,463 | 12/1971 | Foerster | 101/45 X |
| 3,673,960 | 7/1972 | Ricci et al. | 101/269 |
| 3,800,700 | 4/1974 | McInnis et al. | 101/269 |
| 3,916,785 | 11/1975 | Burger et al. | 101/45 |
| 3,946,665 | 3/1976 | Valentine et al. | 101/45 |

*Primary Examiner*—Edward M. Coven

*Attorney, Agent, or Firm*—Gerald J. Ferguson, Jr.; Joseph J. Baker

[57] ABSTRACT

The invention concerns apparatus and method to provide timing imprints on a sheet or sheets. The imprints are characteristically provided in association with other imprints provided by a card having indicia thereon.

14 Claims, 16 Drawing Figures

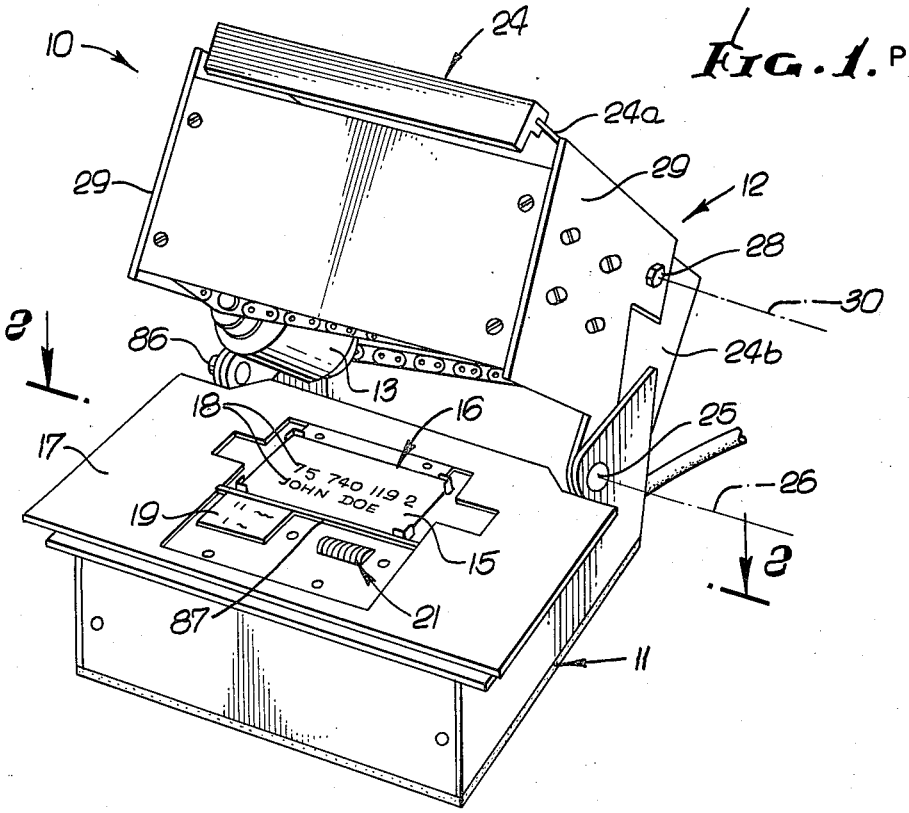
FIG. 1. PRIOR ART
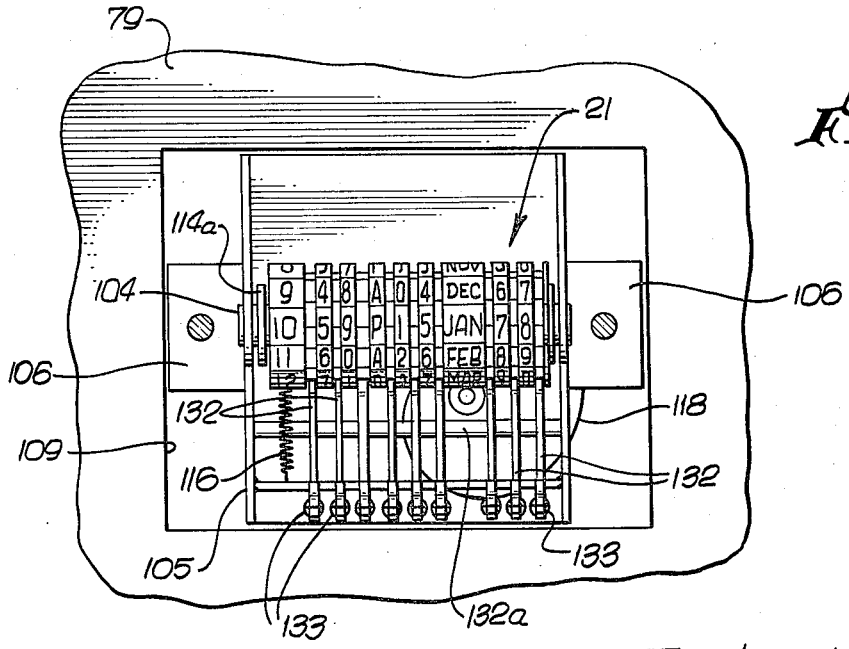
FIG. 6.
PRIOR ART
FIG. 3a.
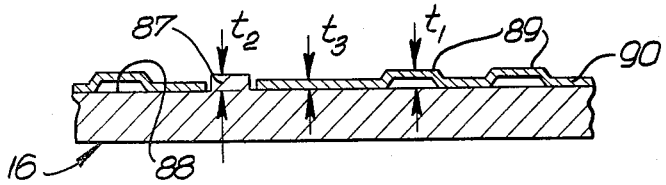

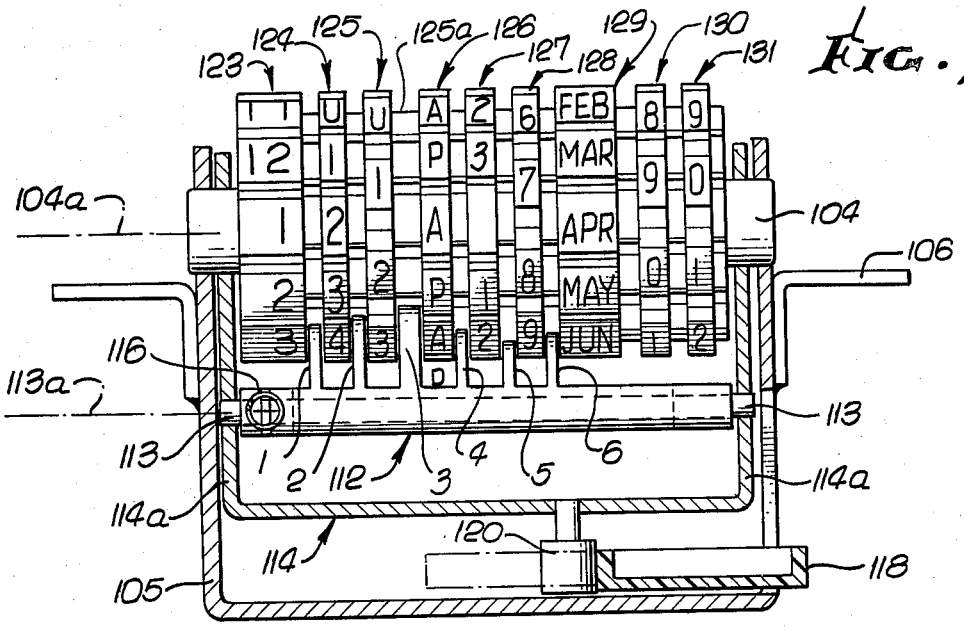
FIG. 7.
FIG. 8.
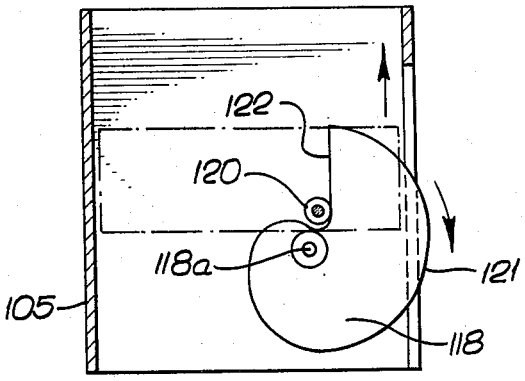
FIG. 9.
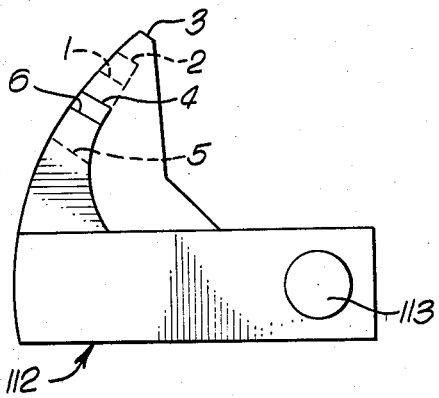
FIG. 10.
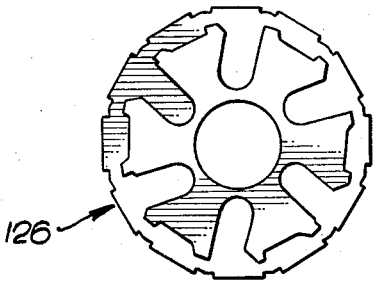
FIG. 11.
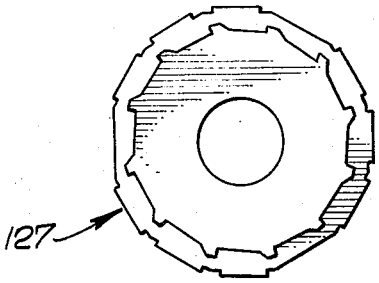

IMPRINTING OF TIME CLOCK DATA

BACKGROUND OF THE INVENTION

This invention relates generally to imprinting, and more particularly concerns method and apparatus to provide timing imprints on a sheet or sheets.

Apparatus described in U.S. Pat. No. 3,800,700 achieves a number of unusual advantages in imprinter structure, mode of operation and results. There is further need for simple and efficient method and means, in association with imprinters, to provide time, or time clock, data on a sheet or sheets processed by imprinters, and particularly of the advantageous type described in that patent.

SUMMARY OF THE INVENTION

It is a major object of the invention to provide method and apparatus meeting the above need. Basically, the apparatus of the invention comprises:

(a) first means providing time data in indicia form for presentation toward the sheet means, (b) control means operatively connected with said first means to automatically and periodically change the indicia presented toward the sheet means, (c) and imprinting structure including a roller mounted for progressive advancement at selected times over the sheet means to urge the sheet means toward the time data indicia which are presented toward the sheet at the selected times.

As will be seen, delay means is operatively coupled with the control means to delay the changing of the indicia during momentary time intervals in which the roller is being advanced over the sheet means to effect the imprint; indicia wheels carrying the indicia may be yieldably supported for displacement away from the roller during its advancement; a rail may limit approach or displacement of the roller directly toward the indicia during roller travel over the sheet means; a table or platen carrying the yieldably supported indicia may itself be yieldably supported to advantage as will be described; and the indicia wheels and pawl ribs engageable with the wheels to selectively advance same may be so related to the support structure as to achieve optimum results.

The basic method of the invention involves the following steps:

(a) providing time data in indicia form, presented toward the sheet means, (b) periodically changing the time data indicia presented toward the sheet means, (c) advancing a roller progressively over the sheet means so as to urge the sheet means toward the time data indicia thereby to effect the imprinting, and (d) yieldably supporting the indicia for displacement away from the roller during such roller advancement.

These and other objects and advantages of the invention, as well as the details of an illustrative embodiment, will be more fully understood from the following description and drawings, in which:

DRAWING DESCRIPTION

FIG. 1 is a perspective showing one form of apparatus incorporating the invention;

Figure 2:
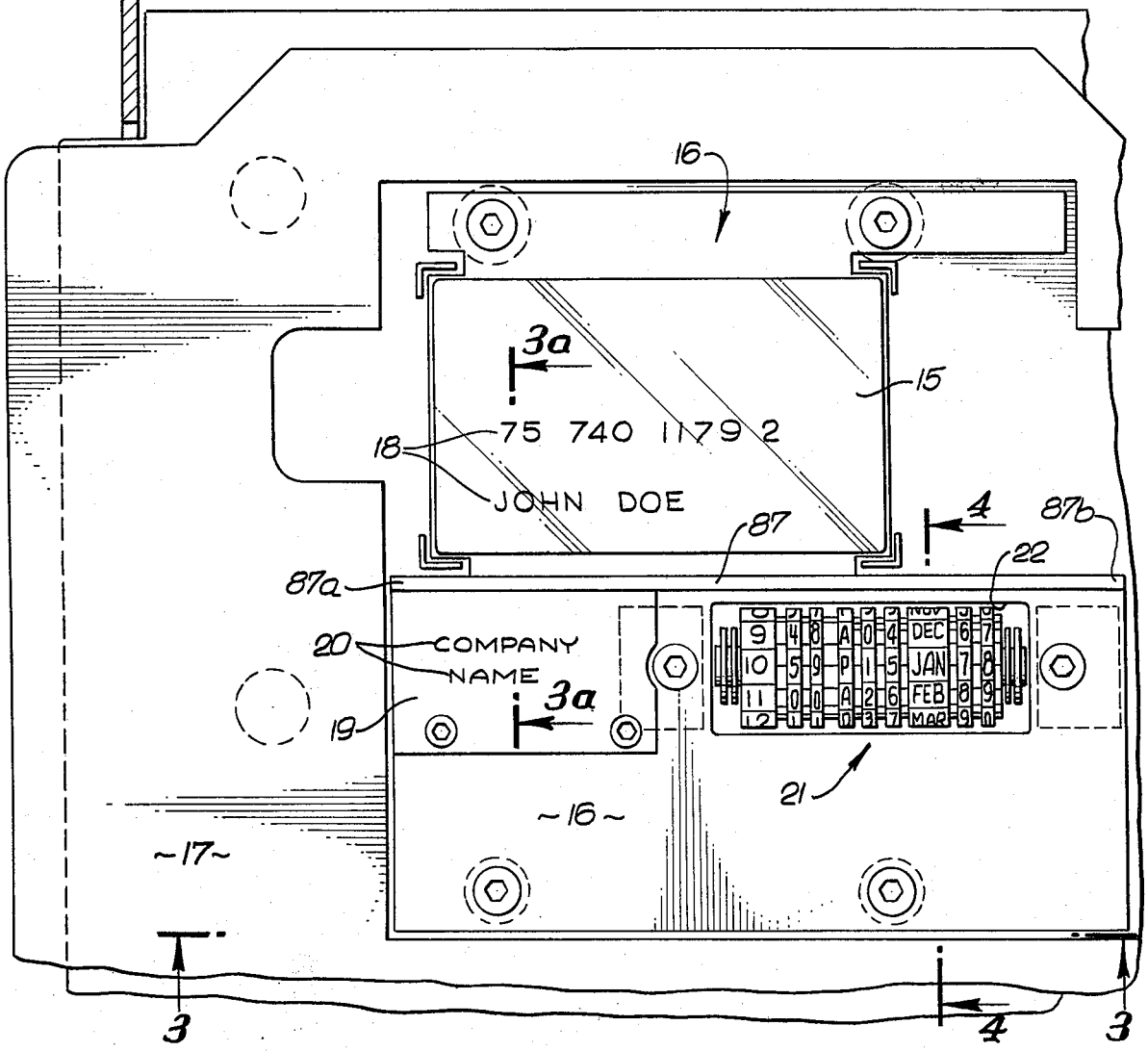
FIG. 2 is an enlarged plan view of lines 2—2 of FIG. 1.
Figure 4:
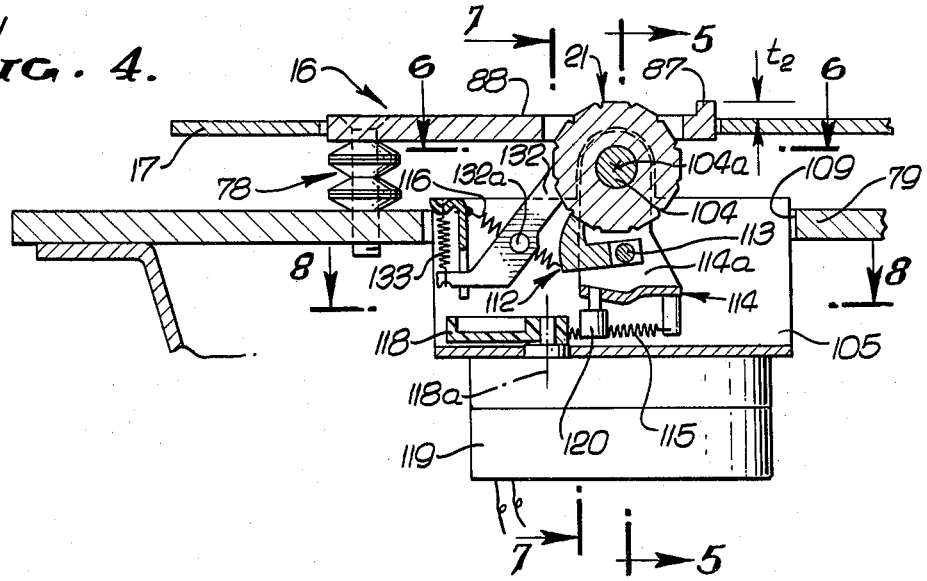
Figure 5:
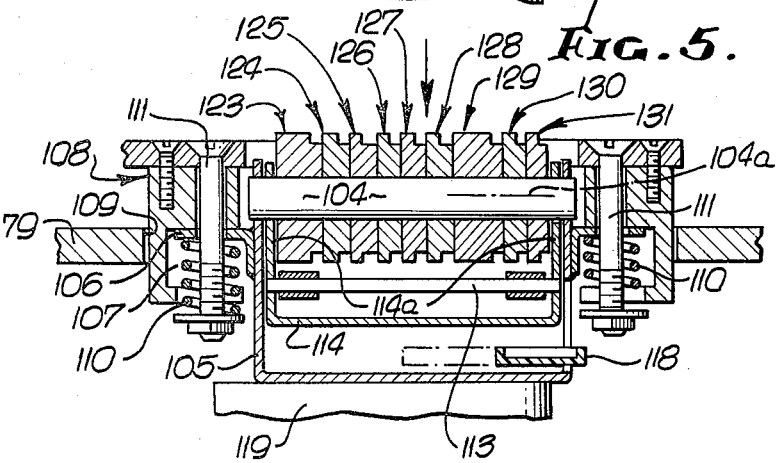
Figure 12:
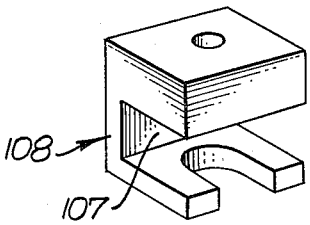
Figure 13:
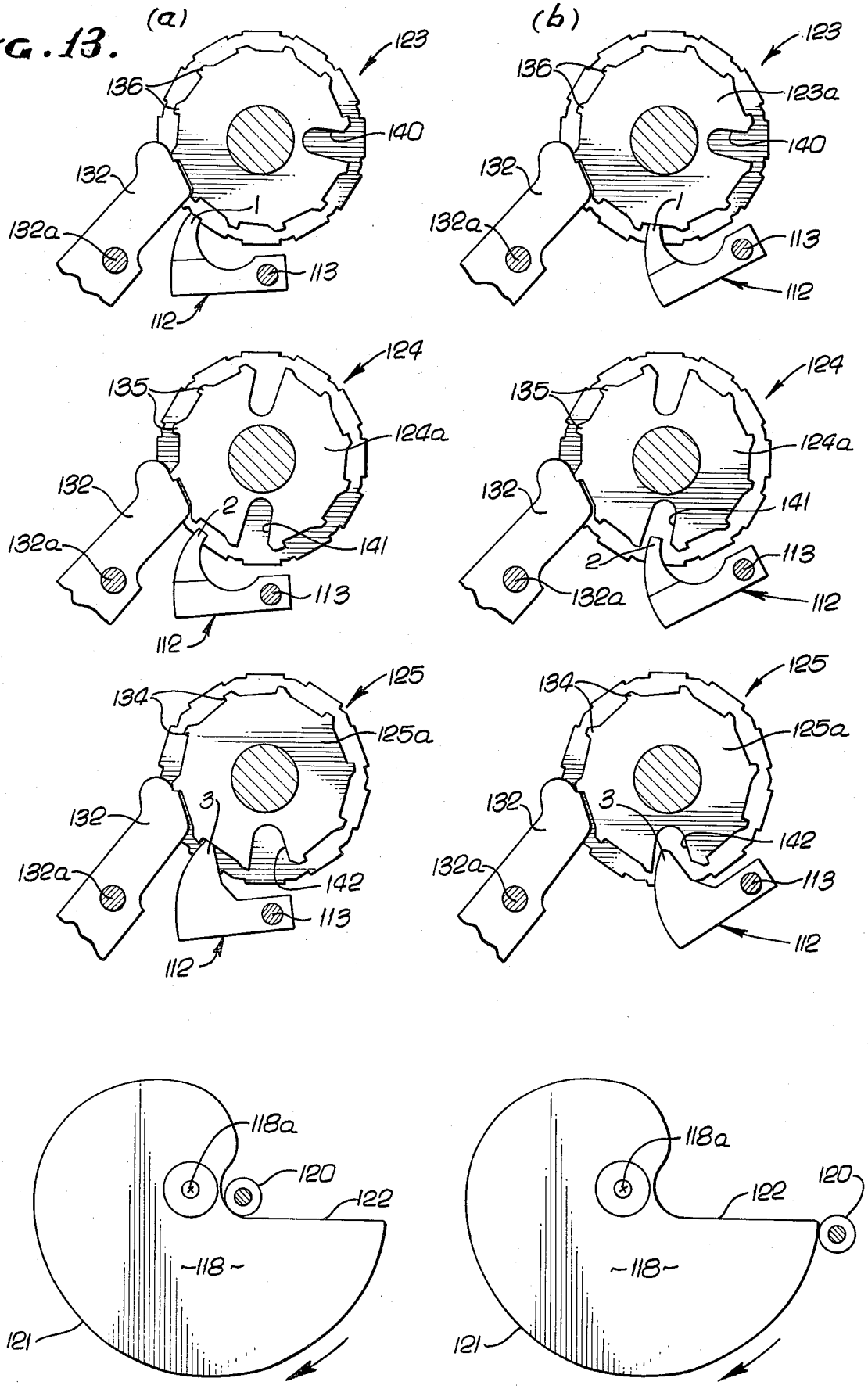
Figure 13:
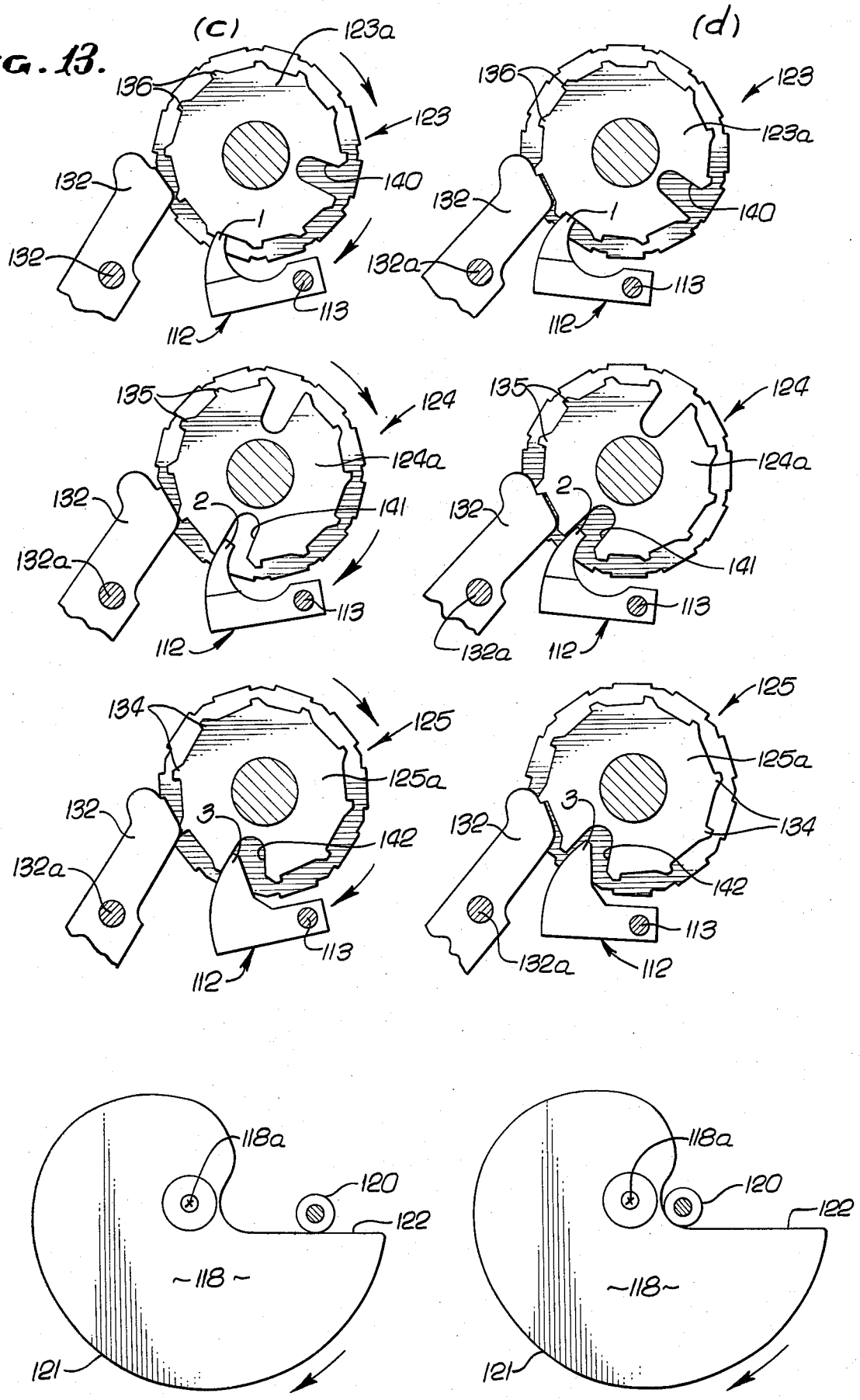
Figure 14:
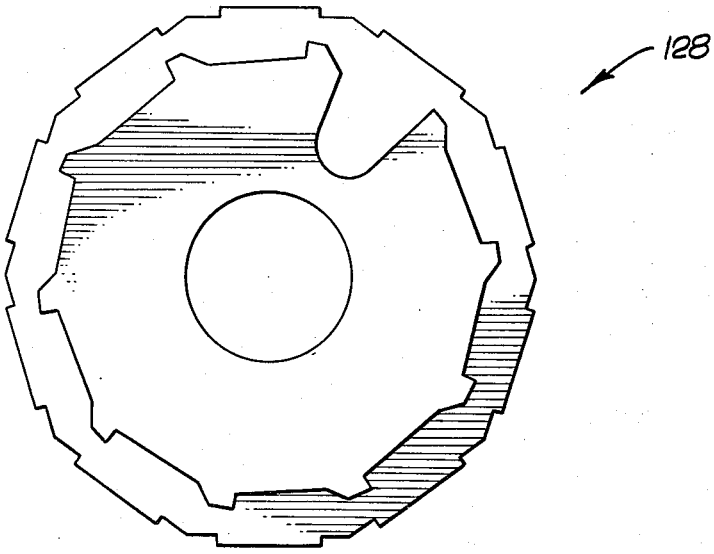
Figure 15:
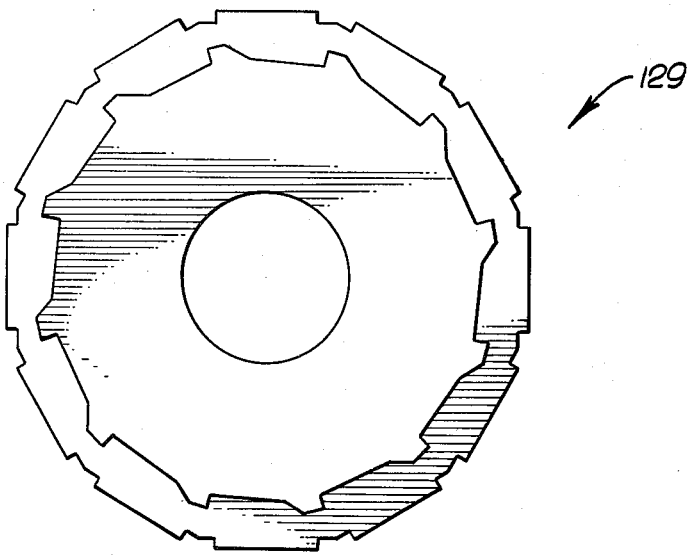

FIG. 3*a* is an elevation on lines 3*a*—3*a* of FIG. 2;

FIG. 4 is a fragmentary section taken on lines 4—4 of FIG. 2;

FIG. 5 is a section on lines 5—5 of FIG. 4;

FIG. 6 is a plan view on lines 6—6 of FIG. 4;

FIG. 7 is an elevation taken on lines 7—7 of FIG. 4;

FIG. 8 is a plan view of a cam taken on lines 8—8 of FIG. 4;

FIG. 9 is a schematic showing various sizes of pawls;

FIG. 10 is an end elevation showing an imprint wheel;

FIG. 11 is an end elevation showing another imprint wheel;

FIG. 12 is a perspective showing mount structure also appearing in FIG. 5;

FIGS. 13(*a*) to 13(*d*) show steps in the operation of time clock apparatus; and FIGS. 14 and 15 are end elevation showing additional imprint wheels.

GENERAL ORGANIZATION

Figure 3:
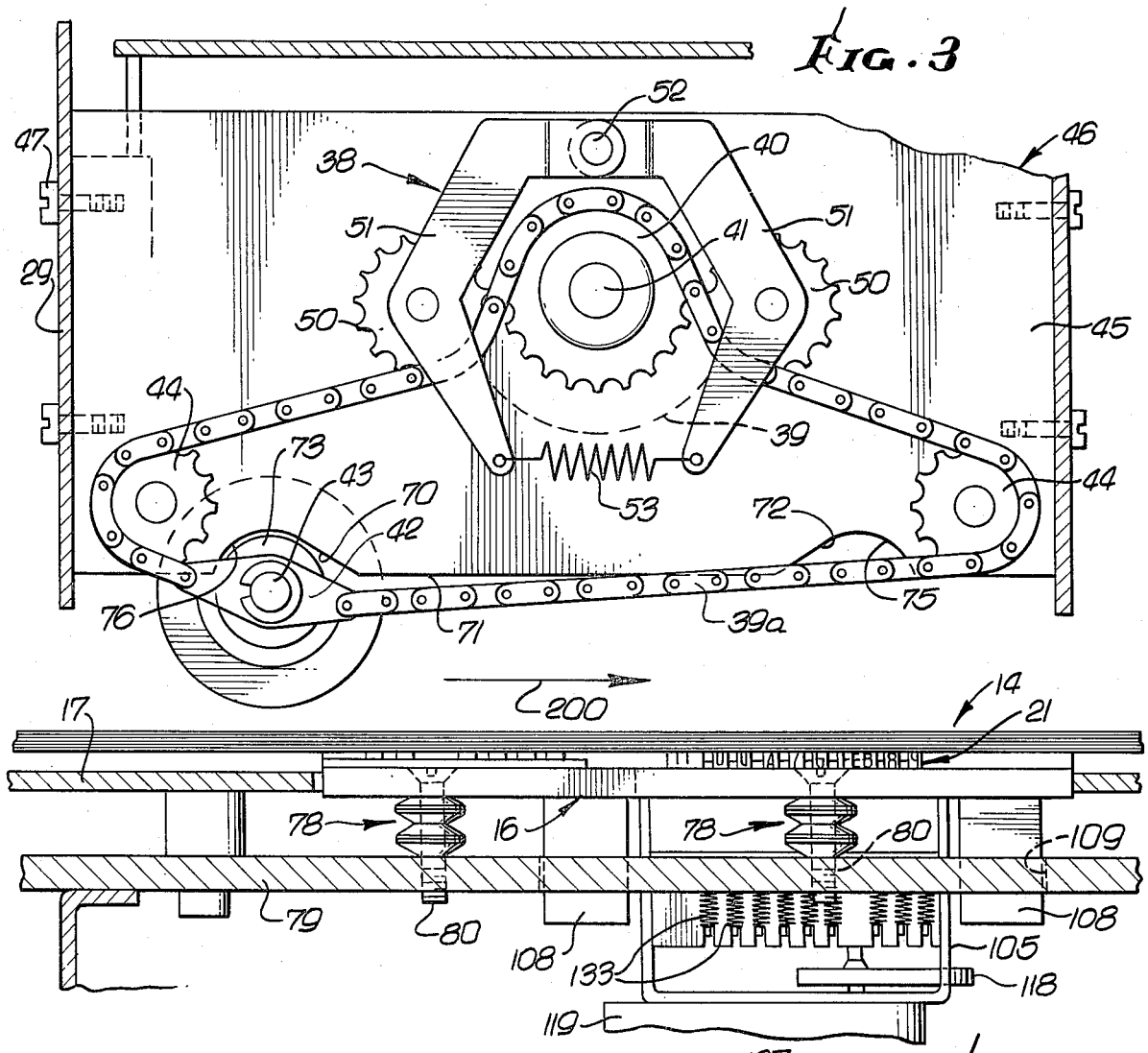
FIG. 3 is an elevation taken on lines 3—3 of FIG. 2.

As shown in FIGS. 1, 2 and 3 one form of imprinting apparatus incorporating the invention may be like that described in U.S. Pat. No. 3,800,700. That apparatus 10 includes base and head sections as for example are seen at 11 and 12. The head section is relatively movable from retracted position (as for example the upwardly pivoted position illustrated in FIG. 1) in which a pressure member such as roller 13 is openly spaced from the base section, to downwardly closed position (as for example is seen in FIG. 3) in which the roller is presented proximate the base section for lateral displacement across and in contact with sheet means 14 (comprising one or more sheets in a stack). When the head section is in retracted condition, the sheet means may be conveniently placed over an indicia carrier 15, a carrier support such as platen 16 and a sheet supporting table 17, elements 15–17 being carried by the base section. The carrier 15 may for example comprise a plastic card removably received on the platen, and which carries embossments 18 defining indicia (as for example a name and serial number) pressurally engageable with the sheet means to effect imprinting of the latter.

Other forms of indicia carriers may be carried by or presented at the platen 16, one example being a small metal plate 19 presenting embossments 20 (for example identifying a company name). Another example is the adjustable 21 assembly of coaxial rotors carrying embossments (for example identifying the month, day and year). The rotor assembly is carried by the base section and received in a through opening 22 in the platen for selected embossment presentation at a preselected level above the upper surface level of the platen.

It will be appreciated that, due to the capability of the head section to be raised or swung upwardly away from the base section, the sheet means 14 and card 15 cannot become jammed or stuck against removal from position between the roller 13 and platen, no matter how many individual sheets are in the stack defining the sheet means. Thus, if for any reason (as for example the attempted imprinting of a too thick bundle of forms) the roller is blocked against completed travel across the indicia zone, the head section may be lifted to immediately free the forms and the removable indicia carrying card and/or plate 15 and 19 for lift-off removal from the base section. Examples of imprintable sheets are carbon paper sheets interposed between other paper sheets such as forms, and so-called NCR paper containing very small, pressure rupturable, ink containing globules.

Referring to FIGS. 1-3, the two sections 11 and 12 may advantageously have pivoted interconnection as at 25 to accommodate upward and downward swinging of the head section about first pivot axis 26. Also, first means is provided to releasably lock the head section in closed position in response to head section movement into closed position. In the example, such first means includes an operating arm 24 which may be generally L-shaped to define arm segments 24*a* and 24*b*. The arm is carried by the head section, as for example at pivot connection 28 to head section side panels 29 defining a second pivot axis 30 parallel to axis 26. The arm segment 24 is also coupled to the base section to displace the head section toward and away from the base section when the arm is rotated in opposite directions relatively about axis 26. Such coupling is more completely described in U.S. Pat. No. 3,800,700, and serves to releasably lock the head section in closed position so that the roller may be displaced across the indicia zone while it exerts substantial force against the sheet means subject to imprinting. Further, unlocking of the sections following imprinting is very simply effected by slight lifting of the arm segment 24*a*.

The described first means, such as includes arm 24, to releasably lock the head section in closed position may advantageously have the further function of effecting energization of the drive serving to displace the roller transversely across the indicia zone, as for example in the direction of arrow 200 in FIG. 3. The drive indicated generally at 38 in FIG. 3 includes an electrical motor 39 carried by the head section and coupled in driving relation with the roller as for example by means of drive chains 39*a* entrained on drive sprockets 40 connected with the oppositely projecting motor output shafts 41. Opposite ends of each chain are connected to roller carriers 42 journaled to the roller trunnions 43. Idler sprockets 44 are carried by the front and rear panels 45 of a drive module or frame 46 removably attached as by fasteners 47 to the head section side panels or support structure 29. This allows removal of the drive module whenever desired for servicing or replacement. All elements of the roller drive carried by the module frame. Chain slack is removed by idler sprockets 50 carried by arms 51 pivoted to the panels 45 at 52, and spring urged at 53 to cause the sprockets 50 to mesh with and deflect the chain as shown.

As described in U.S. Pat. No. 3,800,700, a motor control switch is carried by the module 46 on the head section so as to be actuated upon final lowering of arm segment 24*a* during locking of the head section in closed position. Also, a plate element is shiftable in opposite directions in response to roller travel in opposite directions across the indicia zone, and limit switch means is actuable by the plate element to effect deenergization of the motor upon completion of roller travel across the zone.

Other means is provided to forcibly urge the roller 13 toward the indicia on elements 15, 19 and 21 defining the indicia zone, in response to roller displacement across that zone as described, with the head section locked in closed position. Such other means may advantageously comprise guideways on the head section, as for example are defined by shoulders 70, 71 and 72 on plates 45, together with reduced diameter roller trunnion portions 73 riding on and movable along the guideways in response to roller bodily displacement. Note that the guideways 70 and 72 define ramps angled to displace the roller carriers or trunnions in a direction forcibly moving the roller toward the base section and away from the head section, assuring development of sufficient pressure to effect imprinting of multiple sheets or forms in the stack applied over the embossments defining the indicia. The limits of roller trunnion travel are defined by arcuate shoulders 75 and 76.

Yieldable means such as Belleville washer stacks 78 are carried on base plate 79 to support the platen in such manner as to yield and thereby control the force application to the sheet means by the roller 13, such force application thereby being the same for a wide range of overall thicknesses of the sheet means 14. Fasteners 80 project through the washers and are threadably attached to the base plate, allowing fastener adjustment to control initial compression of the washers and positioning of the platen. The card 15 may be resiliently mounted as described in U.S. Pat. No. 3,800,700. Note also that the platen 16 is endwise reversible 180°, as accommodated by removal of fasteners 80, permitting relocation of the indicia as on card 15 further from the pivots 25 so as to permit imprinting at sheet locations further from the sheet edge advanced against structure locations 86 in FIG. 1.

Referring to FIGS. 1, 2, 3*a* and 4, the platen 16 is seen to carry a rail 87 projecting outwardly from the platen surface 88 to an extent $t_2$ which is less than the outward projection $t_1$ of the indicia 89 on indicia carrying card 90 from the surface 88, but to greater extent than the projection $t_3$ of the main body of card 90 from surface 88. Merely as one example, $t_3$ may be about 0.030 inches; $t_2$ about 0.037 inches; and $t_1$ between 0.040 and 0.050 inches, for a currently used plastic credit card. The purpose of the rail is to prevent smudging of the sheet 14 during imprinting. Note that the rail 87 preferably extends at 87*a* and 87*b* endwise beyond the indicia presented upwardly in FIG. 3*a*. This results in the initiation of rotation of the roller 13 (in response to compressive force transmission to the roller from the rail) prior to arrival of the roller over the raised indicia, so that skewing or other unwanted displacements of the sheet which might then occur are prevented, and irrespective of the degree of clamping force transmission by the roller and the speed of roller travel over the indicia. If desired, the rail surface may be etched or otherwise configured to imprint a pattern such as a name on the sheet means.

Referring now to FIGS. 2, 4, 5 and 7, first means, as for example at 21, provides time data in indicia form for presentation toward the sheet means 14 placed over the anvil or platen 16. Such first means may with unusual advantage take the form of coaxial rotors such as imprint wheels identified at 123–131 mounted for separate and individual rotation on shaft 104. The latter is carried by a U-shaped frame 105 so as to present the uppermost indicia, or imprint fonts, on the wheels at a level slightly above the top surface level of the platen 16, as shown. L-shaped brackets 106 attached to the frame extend within recesses 107 in mounting members 108 connected to the underside of platen 16 and extending through an opening 109 in base plate 79. Springs 110, suspended by adjustable fasteners 111, support the L-shaped brackets, whereby the frame is supported for yieldable downward movement. Such structure may be considered as included in one form of means yieldably supporting the indicia for displacement away from the roller 13 when the latter is progressively advanced at selected times over the sheet means 14. Such advancement urges the sheet means toward the time data indicia on the imprint wheels and which are upwardly presented toward the sheet means. As a result, the indicia wheels will yield downwardly when roller force is applied downwardly to urge the sheets 14 against the indicia means, the compliance of springs 110 being adjustable by fasteners 111 so that desired sharpness of imprinting is achievable for any selected single or multiple sheet or sheets in the sheet means 14. This effect is found to be favorably enhanced by the separate and independent yieldable support of the platen, as via Belleville washers 78, whereby accommodation to a single sheet or a large number of sheets to be imprinted, is achieved to best advantage.

Also provided is control means operatively connected with the first means (i.e. indicia wheels) to automatically and periodically change the time data presented toward the sheet means. Such control means typically includes pawl means engageable with the indicia wheels, and pawl carrier means supported to periodically displace the pawl means so as to selectively rotate the wheels. In the example, the pawl means, is shown to include a single integrated structure 112 having projecting ribs indicated by the numbers 1 through 6. The pawl has trunnions 113 supported by arms 114*a* of U-shaped pawl carrier 114. The latter is in turn carried by shaft 104 to rotate about axis 104*a*. A spring 115 attached to the pawl carrier and to the frame 105 biases the pawl carrier clockwise in FIG. 4. Another spring 116 attached to the pawl and to the frame biases the pawl in a clockwise direction in FIG. 4, i.e. the ribs are urged toward the surfaces of the indicia wheels. Pawl 112 rotates about second axis 113*a* defined by trunnions 113.

The pawl carrier 114 is periodically displaced in a counterclockwise direction in FIG. 4 as by a cam 118 rotatable about vertical cam axis 118*a* in FIG. 4 by a motor 119. A follower 120 projects from the pawl carrier to be displaced by the cam. The cam curved riser surface appears at 121 in FIG. 8 and 13, and drop-off at 122.

The indicia wheels may advantageously take the form as illustrated, and identified by the following:

TABLE

| Wheel | time indication on wheel pads | rib engageable with wheel |
|---|---|---|
| 123 | hour | 1 |
| 124 | minute (decade) | 2 |
| 125 | minute (unit) | 3 |
| 126 | AM/PM | 4 |
| 127 | days (decade) | 5 |
| 128 | day (unit) | 6 |
| 129 | month | — |
| 130 | year (decade) | — |
| 131 | year (unit) | — |

Wheels 129–131 may be periodically adjustably rotated by the user's finger. Detents 132, spring urged at 133, engage the wheels to yieldably resist their rotation in a rotary direction opposite to that of intended wheel advancement by the pawl ribs. The detents are shown as fingers, pivoted at 132*a*.

Generally speaking, the wheels define certain shoulders spaced about axis 104*a* and engageable by the ribs (1–6) so as to selectively rotate those wheels whose drive shoulders are engaged by corresponding ribs, and so as not to rotate those wheels whose certain shoulders are not engaged by the corresponding ribs. See for example the certain wheels 123, 124 and 125 in FIGS. 13(*a*)—13(*d*), which show wheel positions at different cam rotary positions. FIG. 13(*a*) shows rib 3 engaged with minute wheel 125; but ribs 1 and 2 are spaced from hour and minute decade wheels 123 and 124. Disregarding recesses 140, 141 and 142 in these wheels, cam induced counterclockwise rotation of the pawl means 112 to the extent shown in FIG. 13(*b*) would carry the rib 3 over a shoulder 134 on wheel 25, and ribs 1 and 2 would remain out of engagement with wheels 123 and 124; subsequent dropping of the follower off the cam riser would result in spring retraction of the pawl means in a clockwise direction to rotate wheel 125 36°, corresponding to one minute. In this regard, the rib 3 pushes against a shoulder 134 on wheel boss 125*a*. Thus, as the cam fully rotates once each minute, the minute wheel 125 advances one minute indicia (indicated on its pads or fonts).

The ribs are also configured to effect engagement of one selected rib with one selected wheel (for example) only after another selected rib has dropped into a recess associated with another selected wheel; in this regard, the "other" wheel is characterized as rotatable more frequently than the one wheel. In the example, the "one" wheel may take the form of hour wheel 123, and the "other" wheel the form of wheel 124, and/or wheel 125. It is clear from FIGS. 13(*b*), (*c*) and (*d*) that rib 1 will engage wheel 123 (so as to be able to advance it one hour position as a result of engagement with shoulder 136 on boss 123*a*) only after another selected rib (in this case rib 2 on wheel 124 and/or rib 3 on wheel 125) has dropped into a recess (recess 141 on wheel 124 and recess 142 on wheel 125) associated with another wheel. Recess 142 only comes into position to receive rib 3 once each 10 (minute) shiftings of wheel 125; and recess 141 only comes into position to receive rib 2 once each 6 (minute decade) shiftings of wheel 124. Thus, after wheel 125 has shifted 60 times, and wheel 124 has shifted 6 times, the hour wheel is shifted once. In the same manner, the AM/PM wheel 126 is shifted once after 12 shiftings of wheel 123; the day wheel 128 is shifted once after each 2 shiftings of the AM/PM wheel 126; and the decade days wheel 127 is shifted once each 10 shiftings of the day wheel. The month and year wheels 129–131 are shifted by hand.

Shoulders 135 appears on boss 124*a* of wheel 124, to be engaged by pawl rib 2, to advance that wheel as described.

It will be noted from what has been said that the apparatus provides delay means operatively coupled with the control means to delay the changing, i.e. shifting of the indicia during time intervals in which the roller is being advanced over the sheet means 14 to effect the imprint. Such delay means is advantageously afforded by the return spring 115 through which force is transmitted to effect selected wheel rotation in response to motor operation. Thus, while roller pressure is momentarily exerted on the pad of the wheel to be rotated, the spring tension will be insufficient to rotate that wheel clockwise, in FIG. 4.

I claim:

1. Apparatus for imprinting time clock data on sheet means, comprising (a) first means providing time data in indicia form for presentation toward the sheet means, said first means including wheels carrying the indicia, and shaft structure supporting the wheels, (b) control means operatively connected with said first means to automatically and periodically change the indicia presented toward the sheet means, (c) and imprinting structure including a roller mounted for progressive advancement at selected times over the sheet means to urge the sheet means toward the time data indicia which are presented toward the sheet at the selected times, (d) there being a base plate defining a first through opening, a platen to receive the sheet means, said platen having means for presenting further imprint indicia toward the sheet means, the platen overlying the base plate, the platen defining a second through opening, the platen yieldably connected to the base plate, for movement relative to the base plate in response to roller pressure exertion on said further imprint indicia via the sheet means, (e) there being means yieldably connecting the shaft structure and wheels to the platen to move with the platen and further to move relative to the platen in response to roller pressure exertion onto the wheels via the sheet means, said wheels projecting in said second through opening to present the indicia to the sheet means, said connecting means positioned in said first through opening.

2. The apparatus of claim 1 including delay means operatively coupled with said control means to delay said changing of the indicia during time intervals in which the roller is being advanced over the sheet means to effect said imprinting.

3. The apparatus of claim 2 wherein said control means includes a motor and said delay means includes a spring through which force is transmitted to effect selected wheel rotation in response to operation of the motor.

4. The apparatus of claim 1 wherein said connecting means includes mounting member means connected to the platen, bracket means carrying the shaft structure, spring means urging the bracket means toward the mounting member means, and holder means holding the spring means in selected tensioned condition and operatively connected to the platen.

5. The apparatus of claim 4 wherein said holder means comprises at least one adjustable fastener to adjust the compliance of said spring means.

6. The apparatus of claim 1 including a rail on the platen to limit displacement of the roller directly toward the indicia during said roller advancement.

7. The apparatus of claim 1 wherein said wheels are mounted for individual rotation on said shaft structure, said control means includes pawl means engageable with the indicia carrying wheels, pawl carrier means supported to periodically displace the pawl means so as to selectively rotate the wheels, a motor, and a cam driven by the motor to effect said periodic displacement of the pawl carrier means via follower means associated with the pawl carrier means.

8. The apparatus of claim 7 wherein the pawl means includes multiple ribs which are integrally connected and which respectively project toward different of said indicia wheels, there being a frame supporting said wheel shaft structure and also supporting said pawl means for rotation about a second axis spaced from a first axis defined by said wheels, said follower carried by the pawl means, said cam carried by the frame.

9. The apparatus of claim 8 wherein the wheels define certain shoulders spaced about said first axis and engageable by said ribs so as to selectively rotate those wheels whose shoulders are engaged by corresponding ribs, and so as not to rotate those wheels whose certain shoulders are not engaged by the corresponding ribs, a spring biasing said pawl means in a rotary direction about said second axis to urge said ribs toward the indicia wheels, there being recesses in the wheels and the ribs configured to effect engagement of one selected rib with one selected wheel only after another selected rib has dropped into a recess associated with another selected wheel, the other wheel characterized as rotatable more frequently than said one wheel.

10. The apparatus of claim 9 wherein three of said wheels respectively have indicia thereon designating:

(a) minutes (b) selected groups of minutes, and (c) hours.

11. The apparatus of claim 10 wherein another of said wheels has indicia thereon designating:

(d) AM and PM

12. The apparatus of claim 11 wherein two more of said wheels respectively have indicia thereon designating:

(e) days, and (f) selected groups of days.

13. The apparatus of claim 12 wherein there are three additional indicia wheels on said shaft means, and which are rotatable to indicate months, years and decades of years.

14. The apparatus of claim 9 including detent means yieldably resisting rotation of said indicia wheels in a rotary direction opposite to that of intended wheel rotary advancement by said pawl means.

* * * * *